US007104363B2

(12) United States Patent
Mori et al.

(10) Patent No.: US 7,104,363 B2
(45) Date of Patent: Sep. 12, 2006

(54) POWER TRANSMISSION SYSTEM FOR ELEVATOR

(76) Inventors: Kazuhisa Mori, c/o Hitachi, Ltd., Intellectual Property Group New Marunouchi Bldg. 5-1, Marunouchi 1-chome, Chiyoda-ku, Chiyoda-ku, Tokyo 100-8220 (JP); Kouki Yamamoto, c/o Hitachi, Ltd., Intellectual Property Group New Marunouchi Bldg. 5-1, Marunouchi 1-chome, Chiyoda-ku, Tokyo 100-8220 (JP); Hideki Ayano, c/o Hitachi, Ltd., Intellectual Property Group New Marunouchi Bldg. 5-1, Marunouchi 1-chome, Chiyoda-ku, Tokyo 100-8220 (JP); Ikuo Yamato, c/o Hitachi, Ltd., Intellectual Property Group New Marunouchi Bldg. 5-1, Marunouchi 1-chome, Chiyoda-ku, Tokyo 100-8220 (JP); Hiromi Inaba, c/o Hitachi, Ltd., Intellectual Property Group New Marunouchi Bldg. 5-1, Marunouchi 1-chome, Chiyoda-ku, Tokyo 100-8220 (JP); Hirokazu Nagura, c/o Hitachi Ltd., Intellectual Property Group New Marunouchi Bldg. 5-1, Marunouchi 1-chome, Chiyoda-ku, Tokyo 100-8220 (JP); Hideki Nihei, c/o Hitachi, Ltd., Intellectual Property Group New Marunouchi Bldg. 5-1, Marunouchi 1-chome, Chiyoda-ku, Tokyo 100-8220 (JP)

( * ) Notice: Subject to any disclaimer, the term of this patent is extended or adjusted under 35 U.S.C. 154(b) by 0 days.

(21) Appl. No.: 09/970,816

(22) Filed: Oct. 5, 2001

(65) Prior Publication Data

US 2002/0112924 A1 Aug. 22, 2002

(30) Foreign Application Priority Data

Feb. 21, 2001 (JP) ..... 2001-044416

(51) Int. Cl.
*B66B 1/06* (2006.01)

(52) U.S. Cl. ..... 187/290; 187/413

(58) Field of Classification Search ..... 187/289, 187/290, 404, 413; 320/102, 109, 112, 113; 363/132, 58

See application file for complete search history.

(56) References Cited

U.S. PATENT DOCUMENTS 4,303,870 A * 12/1981 Nakamura et al. ..... 104/290

(Continued)

FOREIGN PATENT DOCUMENTS

JP 57112275 7/1982

(Continued)

*Primary Examiner*—Jonathan Salata

(57) ABSTRACT

An elevator having a power feeding apparatus effective for reducing the installation space for the elevator is disclosed.

The dimension of the power transmission part disposed at the hoist way and the dimension of the power receiving part mounted on the counter weight, each measured in the direction along which the counter weight moves are made different from each other.

15 Claims, 14 Drawing Sheets

U.S. PATENT DOCUMENTS

| | | | | | |
|---|---|---|---|---|---|
| 4,402,386 | A | * | 9/1983 | Ficheux et al. | 187/289 |
| 5,732,795 | A | | 3/1998 | McCarthy et al. | |
| 6,333,865 | B1 | * | 12/2001 | Yumura et al. | 187/295 |
| 6,382,361 | B1 | * | 5/2002 | Nihei et al. | 187/289 |
| 6,408,986 | B1 | * | 6/2002 | Ayano et al. | 187/290 |
| 6,412,604 | B1 | * | 7/2002 | Schuster | 187/290 |

FOREIGN PATENT DOCUMENTS

| | | | |
|---|---|---|---|
| JP | 02310279 | A * | 12/1990 |
| JP | 05294568 | | 11/1993 |
| JP | 06255959 | | 9/1994 |
| JP | 07137963 | | 5/1995 |
| JP | 07137964 | | 5/1995 |
| JP | 09124259 | | 5/1997 |
| JP | 10265150 | A * | 10/1998 |
| JP | 2000255932 | | 9/2000 |

* cited by examiner (a) PERSPECTIVE VIEW (b) TOP VIEW

| COMMAND FOR STOPPING AT POWER-FEEDING ENABLE POSITION | YES | NO |
|---|---|---|
| POWER TRANSMISSION CIRCUIT | ON | OFF |

| POWER TRANSMISSION AND RECEIVING PARTS | COUPLED | UN COUPLED |
|---|---|---|
| POWER TRANSMISSION CIRCUIT | ON | OFF |

| SECOND BATTERY POWER REMAINING | FULL | NOT FULL |
|---|---|---|
| POWER TRANSMISSON CIRCUIT | OFF | ON |

POWER TRANSMISSION SYSTEM FOR ELEVATOR

BACKGROUND OF THE INVENTION

The present invention relates to an elevator having an electric power feeding apparatus.

In order to reduce the space for installing an elevator, it is known to the skilled in the art that a driving mechanism for the elevator is installed together in the counter weight and the machinery house to be provided for accommodating the driving mechanism is eliminated. Examples related to this technology are disclosed in the articles, Japanese Patent Laid-Open Number 6-255959 (1994), Japanese Patent Laid-Open Number 7-137963 (1995), Japanese Patent Laid-Open Number 7-137964 (1995), Japanese Patent Laid-Open Number 9-124259 (1997) and Japanese Patent Laid-Open Number 2000-255932 (2000).

Further, what is known publicly include several technologies such as the electric power to be consumed at the car of the elevator is supplied via electrical contact by the electric power supply elements composed of electro-conduction materials or is supplied via contact-less electric feeder by coils and/or transformers. According to those electric power-feeding technologies, it will be appreciated that electric power can be supplied to the car without power feeding cables. Several examples of those technologies are disclosed in the articles, Japanese Patent Laid-Open Number 57-112275 (1982) and Japanese Patent Laid-Open Number 5-294568 (1993).

In case that a driving mechanism for the elevator is mounted on to the counter weight, it is preferable to supply the electric power to the counter weight without using the electric power feeding cable in order to reduce further the space occupied by the installation of the elevator. As for the technologies disclosed in Japanese Patent Laid-Open Number 57-112275 (1982) and Japanese Patent Laid-Open Number 5-294568 (1993), there found the following problems in applying them to the electric power feeding to the counter weight because they are directed for the application for feeding the electric power to the car.

The car and the counter weight are coupled and linked together by a rope, and thus, the positioning accuracy for the counter weight makes lower due to the extension of the rope when attempting to adjust the position of the car. Therefore, the relative position between the power transmission part and the power receiving part of the electric power feeding apparatus may be out of alignment due to the extension of the rope in relative to the electric power feeding to the counter weight. As a result, there are such problems that the efficiency in electric power feeding may be reduced or the electric power feeding itself may be made disabled.

As described above, it is difficult to apply the prior art technologies directly to the electric power feeding to the counter weight due to its low reliability. Thus, even in installing a driving mechanism onto the counter weight, it is required to supply the electric power separately to the counter weight, which leads to a limited amount of reduction in the space occupied by the elevator. In case of applying the prior art technologies, the power transmission part and the power generation apparatus for supplying the electric power, which is to be transferred from the power transmission part to the power receiving part, to the power transmission part are installed within the hoist way inevitably. Thus, the reduction of the space occupied by the elevator may be limited due to the power transmission part and the power generation apparatus.

SUMMARY OF THE INVENTION

The present invention provides an elevator having an electric power feeding apparatus effective to reduce the space occupied by the elevator.

The means for realizing such an elevator as described above includes the followings.

As for the first means, the size of the power transmission part located in the host way and the size of the power receiving part installed at the counter weight, both measured in the direction in which the counter weight travels are made different from each other. As the size of the power transmission part and the size of the power receiving part are different from each other, even if the relative position between the power transmission part and the power receiving part of the electric power feeding apparatus may be out of alignment due to the extension of the rope, a reduction in the efficiency on electric power feeding may be avoided, which leads to higher reliability in electric power feeding.

As for the second means, a couple of power generation apparatus are so arranged so that the projected areas of the first power generation apparatus and the second power generation apparatus for supplying the electric power to the car or the counter weight may be overlapped in the direction along which the car and the counter weight travel. Owing to this configuration, the potential increase in the space occupied by the elevator due to the disposition of those power generation apparatus in the hoist way can be reduced.

As for the third means, a couple of power generation apparatus are so arranged so that the projected areas of the first power transmission part and the second power transmission part for transmitting the electric power to the car or the counter weight may be overlapped in the direction along which the car and the counter weight travel. Owing to this configuration, it will be appreciated that the potential increase in the space occupied by the elevator due to the disposition of those power transmission parts in the hoist way can be reduced.

The forth means is as described below. The first power transmission part for transmitting the electric power is disposed at the first car or the first counter weight moving in the first hoist way, and the second power transmission part for transmitting the electric power is disposed at the second car or the second counter weight moving in the second hoist way. The power generation apparatus for generating the electric power to be transmitted from the first and second transmission parts is further connected commonly to the first and second transmission parts. According to this means, as the electric power supplied from the common power generation apparatus can be supplied to the plural power transmission parts located in the plural hoist ways, it will be appreciated that the potential increase in the space occupied by the elevator though plural transmission parts exist.

The power transmission part at the counter weight or the car supplies the electric power to the electric apparatus consuming the electric power including a driving apparatus, a control apparatus, a lighting apparatus or air conditioning apparatus of the elevator. Those apparatus are preferably mounted in the counter weight or the car. The power transmission part and the power receiving part may contact mechanically to each other, or may not contact mechanically to each other. In case that those do not contact to each other, the electric power is transferred from the power transmission part to the power receiving part via magnetic field, electric field, electromagnetic wave, optical radiation or fluid. The power transmission part is disposed, for example, on the guide rail or the inside wall of the hoist way, and a part or whole of the power transmission part may be disposed inside the hoist way so that the energy may be irradiated toward the power receiving part.

Another solution means may be made obvious from the following description.

DETAILED DESCRIPTION OF THE PREFERRED EMBODIMENTS

Now, referring to the attached figures, the preferred embodiments of the present invention will be described below.

Figure 1:
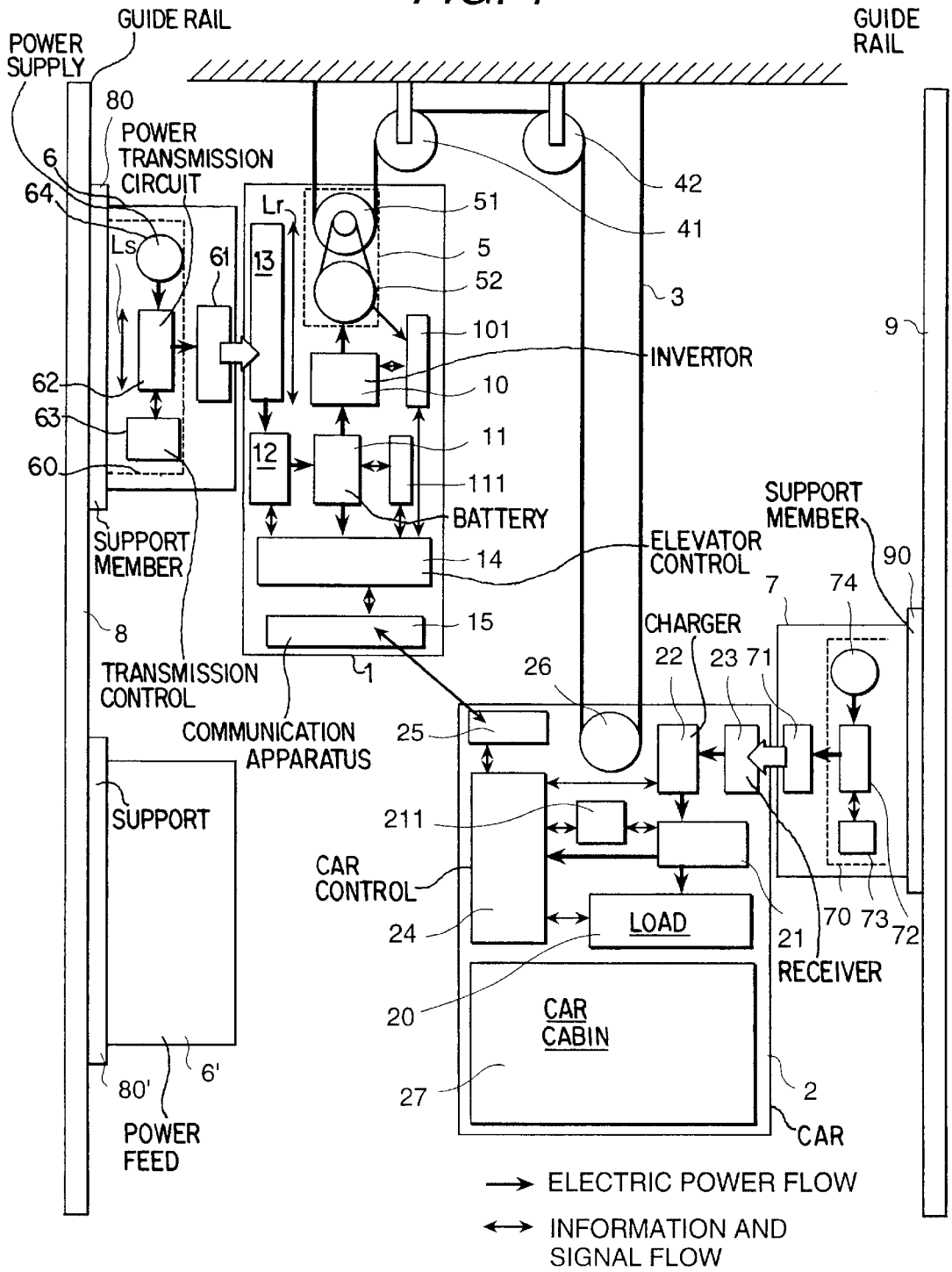
FIG. 1 shows the first embodiment of the present invention.

FIG. 1 shows the first embodiment of the present invention.

The car 2 has a car pulley 26. Though the car pulley is located above the car 2, its position and numbers are not limited to those shown in the figure, and thus it is allowed that a couple of car pulleys may be disposed below the car. The counter weight 1 and the car 2 are suspended by the rope 3 with its end part fixed at the top of the hoist way and the top pulleys 41 and 42 fixed at the top of the hoist way. Though the number of top pulleys are selected to be two for convenience of explanation, the number of top pulleys is not limited to this.

The driving apparatus 5 comprising a winding engine 51 and an electric motor 52 is mounted in the counter weight 1, and the car 2 and the counter weight 1 is made move up and down by this driving apparatus. Though the shaft of the winding engine 51 and the shaft of the electric motor 52 are separated and linked by a belt, it is allowed those shafts may be made coaxial or linked by gears.

A given electric power is supplied to the electric moor 52 by the secondary battery 11 used as a condenser, the inverter 10 and the motor control part 101. The secondary battery 11 is charged by the power receiving part 13 and the charging circuit 12, and its state is monitored by the secondary battery state monitoring part 111. In case that the charging circuit 12 has the functionality of the secondary battery state monitoring part 111, the secondary battery state monitoring part 111 can be eliminated.

The electric power is supplied in non-contact mode from the power feeding apparatus for the counter weight located in a given position in the hoist way to the power receiving part 13 mounted at the counter weight. This power feeding apparatus has a power generation apparatus 60 for the counter weight having a power supply 64, a power transmission circuit 62 and a power transmission control part 63 for controlling the electric power feed, a power transmission part 61 for transmitting in non-contact mode the power generated by the power generation apparatus 60 to the power receiving part 13. It is allowed that the power supply 64 may be a general commercial power source.

The dimension Lr of the power receiving part 13 is made larger than the dimension Ls of the power transmission part 61, both measured in the direction along which the counter weight 1 moves in the hoist way. Owing to this configuration, even if the stop position of the counter weight 1 might be shifted from its expected position due to the extension of the rope 3, an opposed face defined between the power transmission part 61 and the power receiving part 13 can be established. Thus, the electric power transmitted from the power transmission part 61 to the power receiving part 13 can be prevented from being leaked outside of the power receiving part 13. Therefore, even if the stop position of the counter weight might be shifted from its expected position, it will be appreciated that a reduction of the power feeding efficiency or even the disabled power feeding can be avoided. Though it is allowed to make the dimension of the power transmission part larger, the configuration in this embodiment can make the power feeding efficiency higher.

In this embodiment, the power feeding apparatus 6 for the counter weight is supported by the power feeding apparatus supporting member 80 extended from the counter weight guide rail 8. The electric power generation apparatus 60 and the power transmission part 61 both for the counter weight may be embedded inside the wall of the hoist way. In this case, the face of the power transmission part 61 opposed to the power receiving part 13, that is, the face from which the energy is irradiated, is exposed inside the hoist way. Though a couple of power feeding apparatus 6 and 6' are shown in FIG. 1, their positions are not limited to this configuration.

In this embodiment, the electric power required inside the car 2 is also supplied in non-contact mode. The electric power required inside the car 2 includes that for the lighting units and display devices, the door apparatus, and the air conditioning system, if any, in the car cabin 27, the load 20 represents those in FIG. 1. The electric power is supplied to the load 20 by the power receiving part 23, the charging part 22 and the secondary battery 21. A secondary battery monitoring part 211 for monitoring the state of the secondary battery 21 is installed. The car device control part 24 controls the devices installed in the car 2 and communicates with the elevator control part 14 via the communication apparatus 25 and the communication apparatus 15 installed at the counter weight 1. Though it is allowed that the communication apparatus 15 and 25 use the flexible and movable communication cables, those communication cables can be eliminated alternately by using wireless communication.

The electric power is also supplied to the car power receiving part 23 from the power feeding apparatus 7 for the car mounted on the car guide rail 9 with the supporting member 90. The power feeding apparatus 7 for the car has a general power supply 74, a power generation apparatus 70 for the car having the power transmission circuit 72 and the power transmission control part 73, and the power transmission part 71 as in the case of the counter weight. Though a singe unit of the power supply apparatus 7 for the car is used in this embodiment, the number and position of this apparatus is not limited to this configuration. Though the power supply apparatus 7 for the car is located in the lower part of the car guide rail, its position is not limited to this configuration. As the car often stands by at the standard floor in a general elevator, it is preferable to define the position for the power supply apparatus 7 so that the electric power may be supplied to the car at this position.

As for the arrow symbols used to link the individual parts in FIG. 1, the thick lines represent the flow of electric power, and the fine lines represent the flow of information and signal, and the outlined arrow symbols represent the electric power feeding in non-contact mode. Though the electric power to the elevator control part 14 is supplied from the secondary battery 11, it is possible to use plural units for the secondary batteries if necessary, which can be also applied to the car device control part 24 and the secondary battery 21 thereof. Though, in a regeneratative operation mode, The electric power flow for the secondary battery 11, the inverter 10 and the electric motor 52 is made reversed against that shown in the figure, this figure emphasizes supplying of the electric power required for driving the individual apparatus and thus the direction of the arrow represent the forward operation mode.

In FIG. 1, though only the information flow is shown for the motor control part 101, the secondary battery monitoring part 111 and the communication apparatus 15, it is understood that the electric power is supplied from the secondary battery 11, if necessary. This can be also applied to the communication apparatus 25 and the secondary battery monitoring apparatus 211 both for the car. Though the electric power is supplied from the secondary battery 11 mounted at the counter weight 1 commonly to the inverter 10 and the elevator control part 14, it is allowed to separate the secondary battery 11 into the secondary battery dedicated to the inverter and the secondary battery dedicated to the control part in some cases. In such a case, it is allowed also to separate the power receiving part 13 and the charging circuit 12, which is not described now in detail.

As for the method for feeding the electric power in non-contact mode, there are several alternatives such as electromagnetic coupling method, mechanical coupling method using an air blower and an aero generator and microwave coupling method. In case of using electromagnetic coupling which is supposed to be most general, a transformer is formed by the power transmission part 61 and the power receiving part 13, and thus the power transmission circuit 62 establishes a power conversion circuit for supplying the high-frequency power from the commercial power source 64 to the power transmission part 61 used as the primary side of the transformer.

Figure 2:
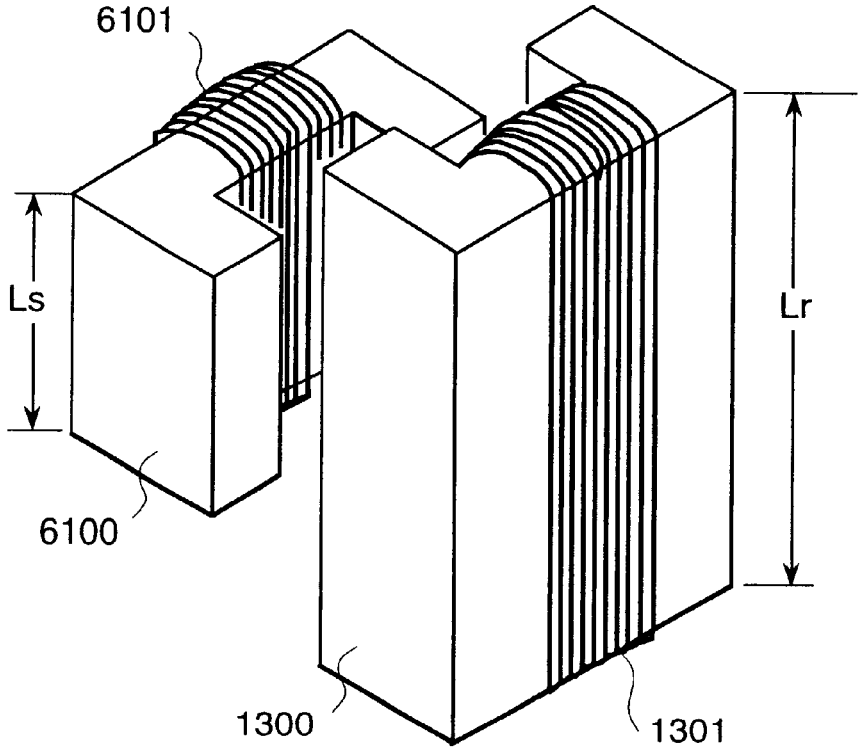
FIG. 2 shows the power transmission part and the power receiving part using elector-magnetic coupling.
Figure 2:
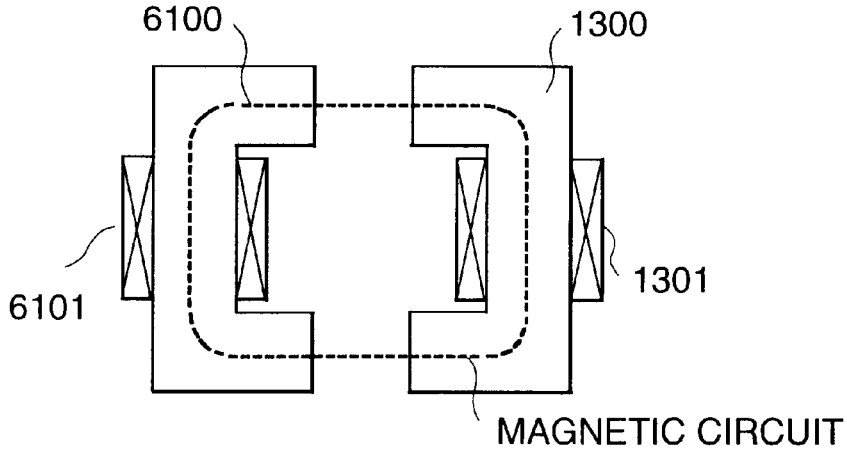
Figure 3:
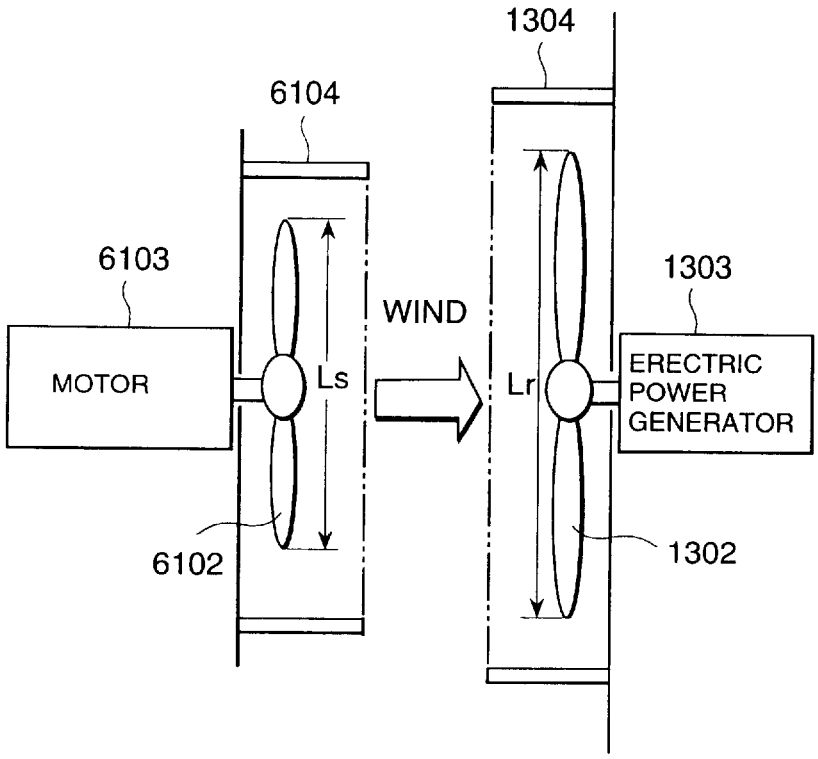
FIG. 3 shows the power transmission part and the power receiving part using wind force energy.
Figure 4:
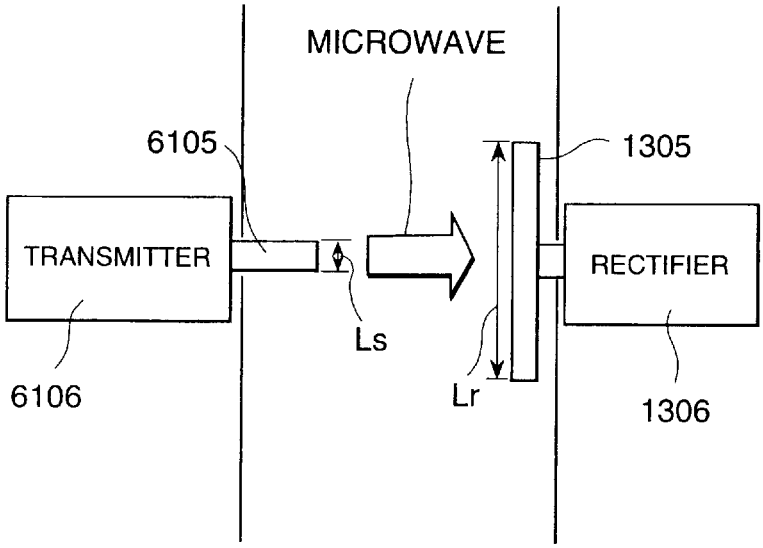
FIG. 4 shows the power transmission part and the power receiving part using microwave.

FIGS. 2 to 4 show examples of the power transmission part and the power receiving part. Those figures illustrate the major parts of the individual components. It is allowed that those major parts may be contained in cases or covered by resinous materials and such if they can exchange the electric energy. Ls is the dimension of the power transmission part and Lr is the dimension of the power receiving part, both measured in the direction along which the counter weight moves in the hoist way. In the individual figures, Lr is larger than Ls.

FIG. 2 shows an example of the structure of the power transmission part 61 and the power receiving part 13 in case of using electromagnetic coupling. FIG. 2(*a*) is a perspective view and FIG. 2(*b*) is a top view. The power transmission part 61 comprises a primary side core 6100 and a primary side winding 6101. The power receiving part 13 comprises a secondary side core 1300 and a secondary side winding 1301. Though there are several alternatives in the shape of coils, the shape used in this embodiment is such that U-shaped cores are faced to each other. The electric power is exchanged by electromagnetic coupling generated by the magnetic circuit formed with the primary side core 6100, the secondary side core 1300 and their gap. As described earlier, the dimension of the power receiving part 13 is made larger in order to reduce the effect by the extension of the rope.

As for the method for feeding the electric power in non-contact mode, FIG. 3 shows a method of using wind power. The power transmission part 61 comprises a propeller 6102, a motor 6103 and a hood 6104, and the power receiving part 13 comprises a propeller 1302, an electric power generator 1303 and a hood 1304. Wind is generated by the rotational movement of the propeller 6102 driven by the motor 6103 at the power transmission part, and thus the propeller 1303 at the power receiving part is made rotate. The electric power generator 1303 linked to the propeller 1302 converts the rotational movement to the electric energy. Various shapes may be used for the propellers and the hoods.

As for the method for feeding the electric power in non-contact mode, FIG. 4 shows a method of using microwaves. The power transmission part 61 comprises a microwave transmission antenna 6105 and a transmitter 6106, and the power receiving part 13 comprises an antenna 1305 and a rectifier 1306. The microwave generated at the transmission antenna 6105 is received by the received by the receiving antenna 1305 and rectified by the rectifier 1306, and then the electric power is supplied. Using such a microwave as having a short wave length can downsize the antenna. It is possible to make the transmission antenna 6105 and the receiving antenna 6103 close to each other as far as the up-and-down operation of the car is not disturbed, and their propagation loss is not so high. Using a directional antenna can increase the power transmission efficiency.

It will be appreciated that, as shown in FIG. 1, the electric power can be supplied with higher reliability by means of feeding the electric power in non-contact mode to the driving apparatus for the counter weight or the devices inside the car.

Figure 5:
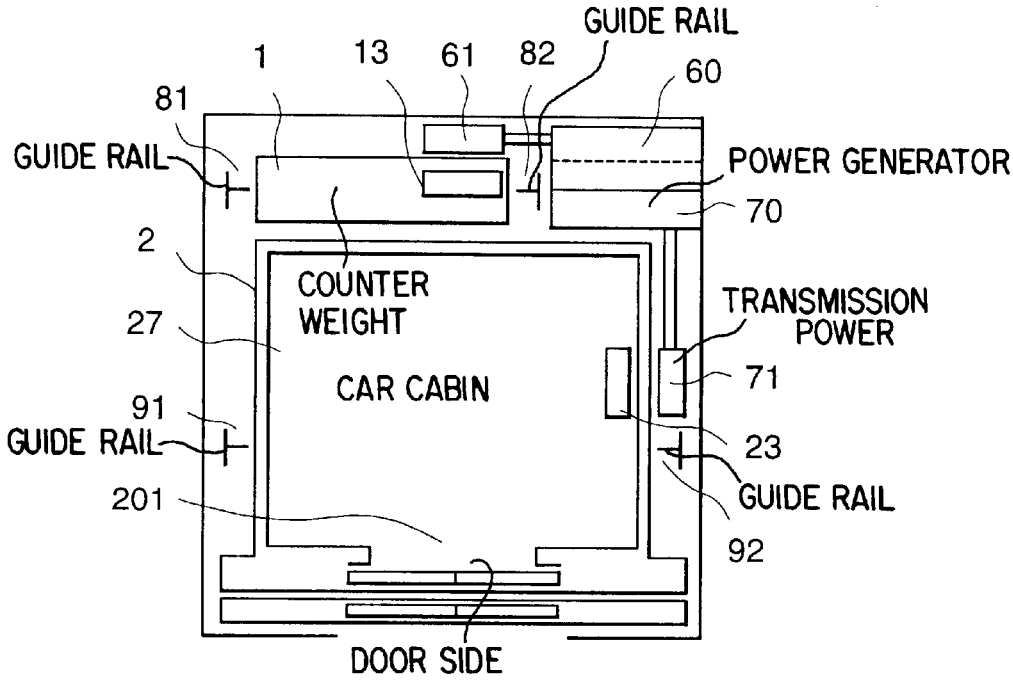
FIG. 5 shows a plane view of the hoist way in the first embodiment.

FIG. 5 shows a plan view of the hoist way in the first embodiment of the present invention. In FIG. 5, the counter weight 1, the car 2 and their individual power feeding apparatus 6 and 7 are projected onto a plane vertical to the direction in which the counter weight 1 or the car 2 moves, that is, goes up and down. Only the power receiving part 13 among the apparatus mounted on the counter weight 1 and only the power receiving part 23 among the apparatus mounted on the car 2 are shown in FIG. 5, and the rest are not shown. The components forming the power feeding apparatus 6 other than the power transmission part 61 which is required to locate nearby the power receiving part 13 are represented by the power generation apparatus 60, and similarly, the components forming the power feeding apparatus 7 for the power receiving part 23 for the car are also represented by the power generation apparatus 70. Assuming that the front side of the car 2 is defined as its door side 201, the counter weight 1, the power transmission part 61 for feeding the electric power to the counter weight 1 and the power generation apparatus 60 for the counter weight are located backside the car 2 and inside the hoist way. The power receiving part 13 is disposed at the counter weight 1 so as to face to the power transmission part 61. The power transmission part 71 for feeding the electric power to the car 2 is disposed at the side face of the car 2 and inside the hoist way, and the power generation apparatus 70 for the car is disposed backside the car 2 and inside the hoist way.

Though the guide rails 81 and 82 for guiding the movement of the counter weight 1 and the guide rails 91 and 92 for guiding the movement of the car 2 are shown, rollers or guide shoes working as mechanical contact to those rails are not shown in FIG. 5.

The broken line representing the projection of the power generation apparatus 60 for the counter weight and the power generation apparatus 70 for the car means that their projected areas on the plane are overlapped partially to each other. That is, the projected areas of the power generation apparatus 60 for the counter weight and the power generation apparatus 70 for the car, being projected in the direction along the car or the counter weight moves, have an overlapped area. As those apparatus are located at the positions with their own elevations, the area occupied by the hoist way can be reduced by arranging those apparatus so as to overlap each other on the vertically projected area. Though such a layout as the areas of the power transmission circuits may overlap partially each other is used in this embodiment, it is allowed to use such a layout as whole of those areas may overlap each other, in some cases. This consideration can be applicable to their individual power transmission parts 61 and 71.

Figure 6:
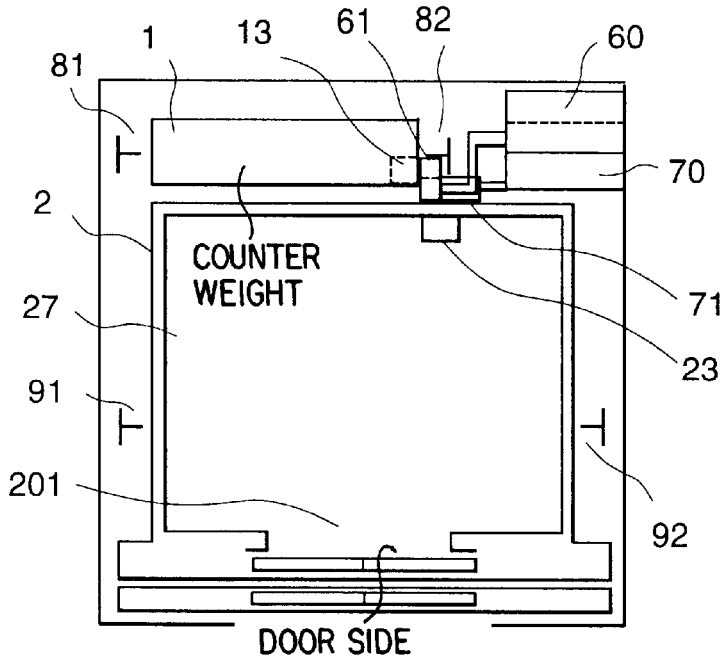
FIG. 6 shows a modification example in which power transmission parts overlaps each other.

FIG. 6 shows a modification example of the layout in which the power transmission parts 61 and 72 overlap partially each other. The broken line representing the projection of the power generation apparatus 60 for the counter weight and the power generation apparatus 70 for the car means that their projected areas on the plane are overlapped partially to each other. In addition, a part of the power transmission part 61 and a part of the power transmission part 71 overlap partially each other. That is, the projected areas of the power transmission part 61 and the power transmission part 71, being projected in the direction along the car or the counter weight moves, have an overlapped area. With this configuration, it will be appreciated that the area occupied by the hoist way can be reduced. The non-conduct mode power feeding can be used without expanding the cross section of the hoist way too much.

Though the supporting mechanisms for the power transmission part 61 or 71 and the power generation apparatus 60 or 70 are not shown in FIG. 5, those components are supported directly or with the supporting member by the guide rail or the bracket for fixing the guide rail onto the hoist way. Thus, there is no need for additional mechanical workings for fixing parts on the inside wall of the hoist way. In addition, as the relative position of the power transmission part 61 to the guide rail 81 or 82 does not change, there is a little change in its relative position to the counter weight 1 changes, which leads to higher reliability in non-contact mode electric power feeding from the power transmission part 61 to the power receiving part 13.

Figure 7:
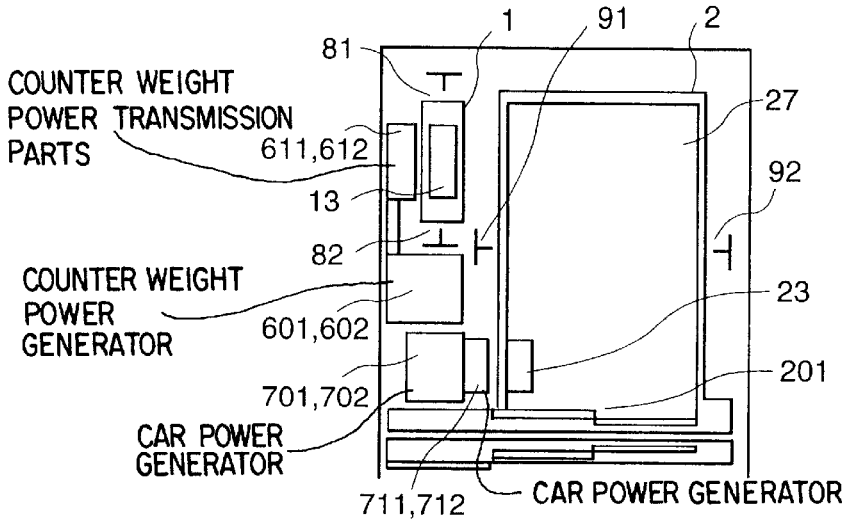
FIG. 7 shows a plane view of the host way in the second embodiment of the present invention.

FIG. 7 shows a plan view of the hoist way in the second embodiment of the present invention. FIG. 7 shows a projected image of the hoist way onto an identical plane in the similar manner to FIG. 5. Only the layout of the car 2 and the counter weight 1 in this case is different from that in FIGS. 5 and 6. In this case, the counter weight 1 is disposed at the side face of the car 2 and inside the hoist way. The power transmission parts 611 and 612 for the counter weight, the power generation apparatus 601 and 602 for the counter weight, the power transmission parts 711 and 712 for the car and the power generation apparatus 701 and 702 for the car are disposed at the wide wall of the car 2 and inside the hoist way. The power receiving part 13 is mounted at the counter weight 1 so as to face to the power transmission parts 611 and 612. The power receiving part 23 is mounted at the car 2 so as to face to the power transmission parts 711 and 712. This figure shows an example in which a couple of power transmission circuits and a couple of power transmission parts are individually disposed in different positions. The electric power to the power receiving part 13 for the counter weight is supplied from a couple of power transmission parts 611 and 612 with their projected areas onto an identical plane being overlapped each other. The electric power to the individual power transmission parts 611 and 612 is supplied from their individual power generation apparatus 601 and 602. The electric power to the power receiving part 23 for the car is also supplied from the power transmission parts 711 and 712, and the power generation apparatus 701 and 702.

Though a couple of power transmission apparatus are disposed individually at the two positions in the counter weight and the car, it is allowed that only a single power transmission apparatus may be disposed at each position, or that three or more power transmission apparatus may be disposed at each position. Even in this case, it is allowed apparently that the power generation apparatus 601 and 602 for the counter weight and the power generation apparatus 701 and 702 overlap each other on the projected plane as in the first embodiment.

It will be appreciated that, the electric power can be supplied as the case may be varied for the relative position between the car 2 and the counter weight 1, and that an increase in the cross section of the hoist way can be reduced even if plural power feeding apparatus are disposed.

The layouts for the power transmission part shown in FIGS. 5 to 7 are illustrative examples, and its position may be so determined properly that it may not block the up-and-down movement of the car 2 and the counter weight 1, and the highly efficient and highly reliable power feeding to the individual power receiving parts may be established. Though the power transmission part is located at a position where it does not overlap the counter weight and the car on their projected plane, it is further allowed that those components may overlap one another as far as they does not block the up-and-down movement, which may lead to a smaller cross section of the hoist way. This modification is shown as in FIG. 8.

Figure 8:
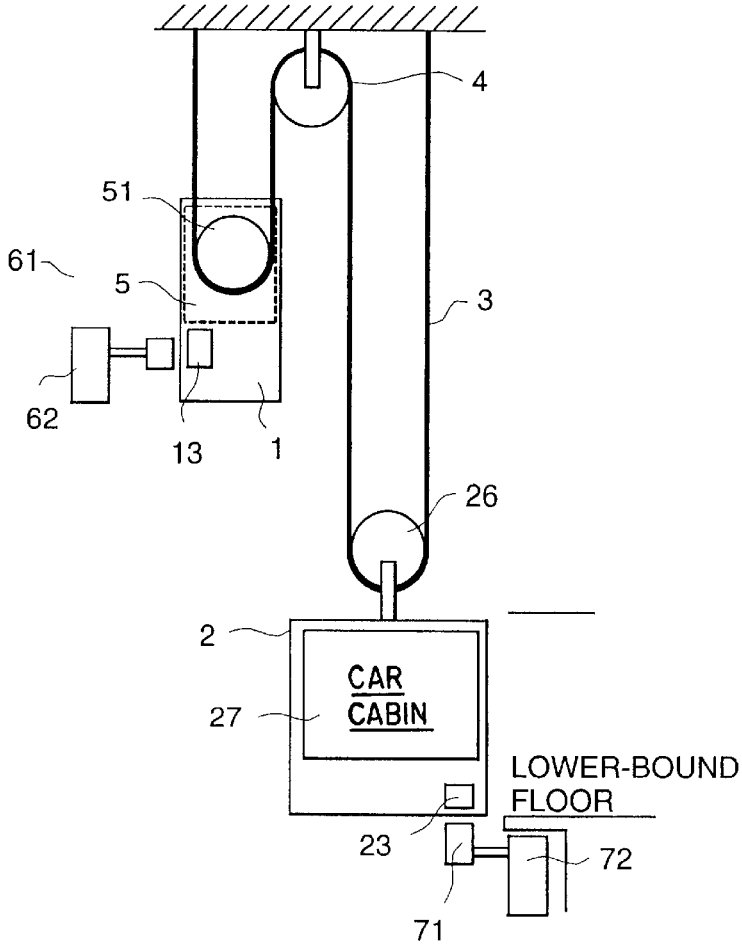
FIG. 8 shows the third embodiment of the present invention.

FIG. 8 shows the third embodiment of the present invention, in which the power transmission part 71 for the car is disposed at the region on which the car 2 is projected. This layout can make smaller cross section of the hoist way. In the example shown in FIG. 8, though only the power transmission part 71 for the car is made disposed within the projected area of the car2, this layout condition may be applied to the power transmission part 61 for the counter weight.

In the individual above-described embodiments, though the power receiving part 13 is assumed to be located within a rectangle area defined as a projection of the counter weight 1, it is allowed that it may be located outside this rectangle area as far as it does not block the up-and-down movement of related components. In addition, as an alternative, the horizontal position of the power receiving part 13 may be shifted horizontally from the up-and-down operation to the stopping or stationary position, which requires an additional driving apparatus to make the power receiving part move horizontally. In this case, the drive power for this additional driving apparatus can be supplied from the secondary battery 11 or 21 mounted on the counter weight 1 or the car 2.

Figure 9:
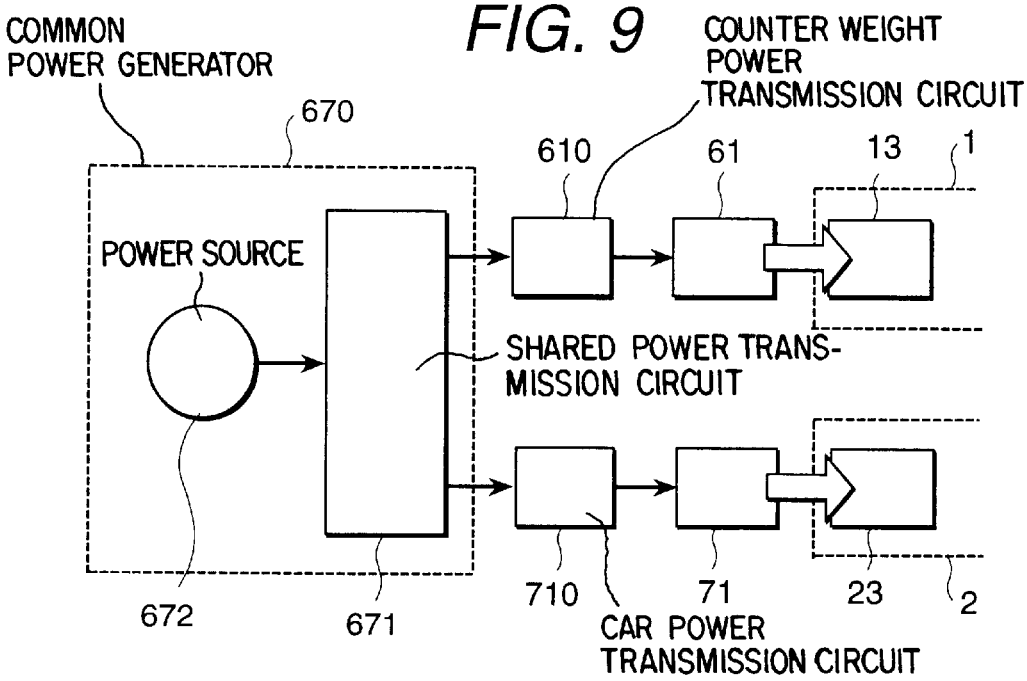
FIG. 9 shows the forth embodiment of the present invention.

FIG. 9 shows the forth embodiment of the present invention. FIG. 9 illustrates a configuration in which a part of the power transmission apparatus 6 for the counter weight and a part of the power transmission apparatus 7 for the car are commonly shared. The electric power feeding to those apparatus can be operated in an identical principle, and in case that the power transmission part 61 for the balance weight and the power transmission part 71 for the car are located within a relatively short distance, it will be appreciated that a part or whole of the individual power transmission apparatus 6 and 7 can be shared to each other. The electric power is supplied from the common power generation apparatus 670 comprising a shared commercial power source 672 and a shared power transmission circuit 671 through the power transmission circuit 610 dedicated for the counter weight and the power transmission part 61 dedicated for the counter weight to the power receiving part 13 mounted on the counter weight 1. In the similar manner, the electric power is supplied through the power transmission circuit 710 dedicated for the car and the power transmission part 71 dedicated for the car to the power receiving part 23 mounted on the car 2. Thus, the reduced number of component parts and the downsizing of the apparatus can be attained by sharing parts of the power feeding apparatus. What is shown in FIG. 9 contains only the flow of electric power but excludes the flow of control signals and information.

In this embodiment, what is shown is such an example that the power feeding apparatus for the counter weight and the power feeding apparatus for the car are partly shared, but it is allowed to share the whole body of the power feeding apparatus itself, if possible. In addition, in case that plural power transmission parts for the counter weight or the car exist, it will be appreciated that the downsizing of the apparatus and the reduced number of component parts can be attained also by sharing the power feeding circuits.

Figure 10:
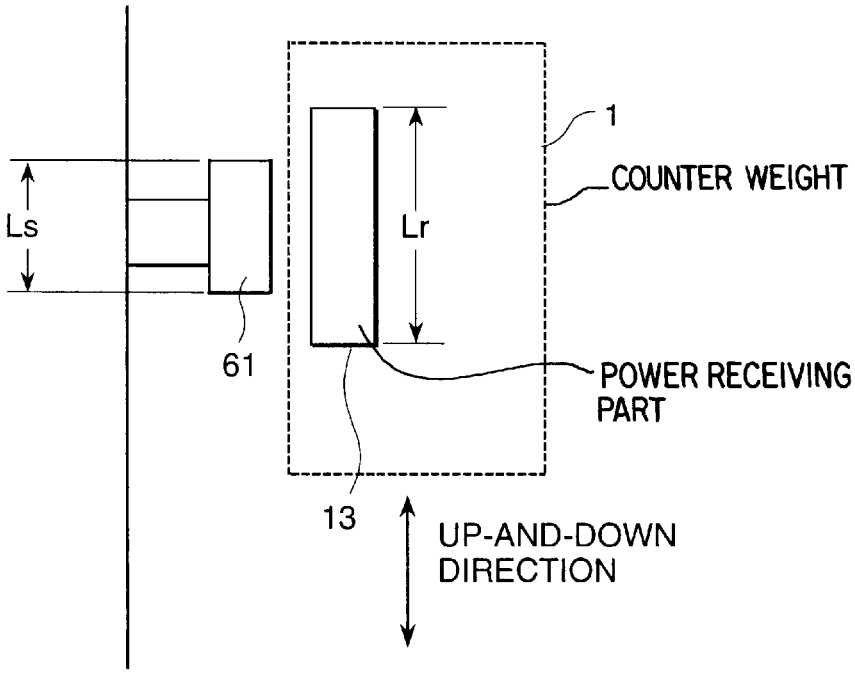
FIG. 10 shows a shape of the power transmission part and the power receiving part.

Now referring to FIG. 10, the shape of the power transmission part and power receiving part for the counter weight in the above-described embodiments is described. In FIG. 10, the dimension Lr of the power receiving part 13 is made larger than the dimension Ls of the power transmissions part 61, both measured in the direction along which the counter weight 1 moves in the hoist way. By making the dimension Lr longer enough for compensating the stop position displacement of the counter weight due to the extension of the rope, it will be appreciated that the power feeding efficiency does not change so much and hence stable electric power feeding can be obtained even if there may occur such a shift in the stop position of the counter weight. It is allowed to form the power receiving part 13 as separates units of plural power receiving parts. In this case, the dimension Lr can be made larger substantially. As shown in FIG. 6, a power receiving part having a continuous and extended shape has higher power feeding efficiency. On the other way, it is possible to reduce the effect by such a shift in the stop position of the counter weight only by extending the length of the power transmission part. The longer the dimension of the power receiving part 13 is as shown in FIG. 6, the less the energy generated at the power transmission part 61 is leaked outside the power receiving part 13 and the higher the power feeding efficiency is.

Figure 11:
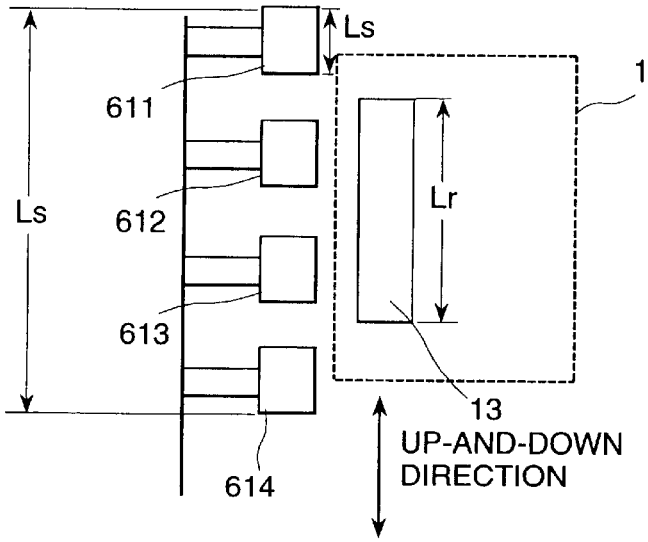
FIG. 11 shows a modification example of the shape of the power transmission part and the power receiving part.

FIG. 11 illustrates a modification example of the power transmission part and the power receiving part shown in FIG. 10, in which the electric power is fed from plural units of power transmission part to a single power receiving part 13. There are four units of power transmission part 611, 612, 613 and 614 in the arrangement shown in FIG. 11. The dimension ls of the individual unit of power transmission part measured in the direction along which the counter weight 1 moves in the hoist way is shorter than the dimension Lr. The dimension Ls of the power transmission part formed by integrating four units of power transmission part is longer than Lr. Owing to this configuration, even if the stop position of the counter weight might be drifted due to the extension of the rope, it will be appreciated that a reduction of the power feeding efficiency or even the disabled power feeding can be avoided. In stead of supplying the electric power from all the four units of power transmission part, it is allowed that the electric power is only supplied to the unit power transmission parts 612 and 613 temporarily facing to the power receiving part 13 as shown, and that the electric power is not supplied to the unit power transmission parts 611 and 614 coming away from the power receiving part. According to this configuration and operation, the fraction of energy leaked from the power transmission part outside the power receiving part can be reduced, and thus it will be appreciated that the power feeding efficiency can be increased. In this embodiment, the electric power is supplied in non-contact mode by using the electromagnetic coupling formed by the power transmission part and the power receiving part, both working as a transformer. Therefore, which unit of power transmission part is now facing to the power receiving part 13 can be determined by detecting the inductance defined at the power transmission circuit.

Figure 12:
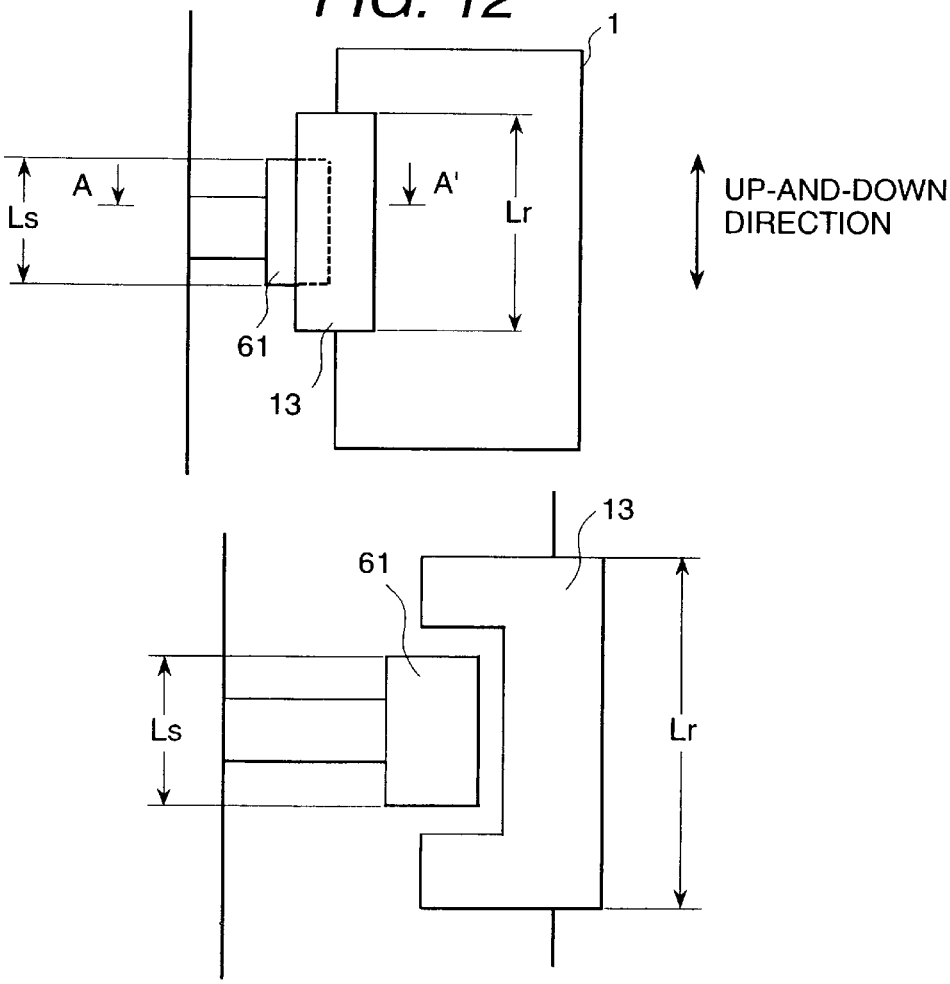
FIG. 12 shows another modification example of the shape of the power transmission part and the power receiving part.

FIG. 12 illustrates a further modification example of the power transmission part and the power receiving part. In the configuration shown by FIG. 12, the power transmission part 61 and the power receiving part 13 overlaps each other in their side view. Owing to this configuration, as the thickness of the power transmission and receiving parts is substantially smaller, it will be appreciated that the space occupied in the hoist way can be reduced and thus the cross section of the hoist way can be reduced. Lr is longer than Ls also in this embodiment. Minor parts and components are not shown in this figure. There are various shapes for the power transmission part 61 and the power receiving part 13 as far as the up-and-down movement of the counter weight is not blocked. Though this figure illustrates the counter weight 1 mainly, there are various shapes of the power transmission part 71 and the power receiving part 23 similarly for the car 2.

Figure 13:
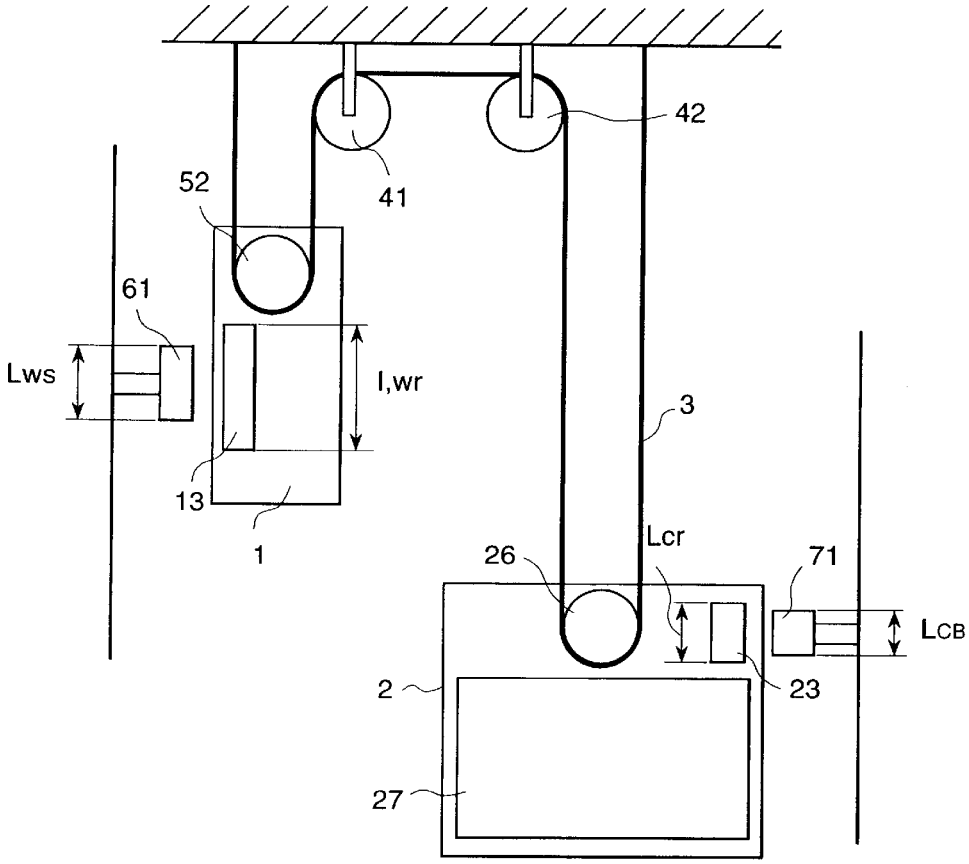
FIG. 13 shows the fifth embodiment of the present invention.

FIG. 13 shows the fifth embodiment of the present invention. In FIG. 13, the ratio of the dimension Lwr of the power receiving part 13 for the counter weight to the dimension Lws of the power transmission part 61, λw=Lwr/Lws is larger than the ratio of the dimension Lcr of the power receiving part 23 for the car to the dimension Lcs of the power transmission part 71, λc=Lcr/Lcs. Lwr and Lws are measured in the direction along which the counter weight 1 moves in the hoist way, and Lcr and Lcs are measured in the direction along which the car 2 moves in the host way. As Lwr is made larger than Lws, the reliability of electric power feeding to the counter weight is as high as the above-mentioned embodiments. Though Lcr is also made larger than Lcs in the car, its ratio (that is, λc) is smaller than the ratio (λw) for the counter weight. However, as the accuracy in positioning the car to a given floor is higher than that the accuracy in positioning the counter weight is, the reliability for electric power feeding to the car 2 may be high enough only by making Lcr a little higher than Lcs even if λc is small. In addition, in case that the material cost for the power receiving part 13 for the counter weight and the power receiving part 23 for the car is determined by the length or volume of the power receiving part, as the size of the power receiving part 23 for the car can be made smaller than the size of the power receiving part 13 for the counter weight, the cost for the power feeding apparatus can be reduced resultantly.

Figure 14:
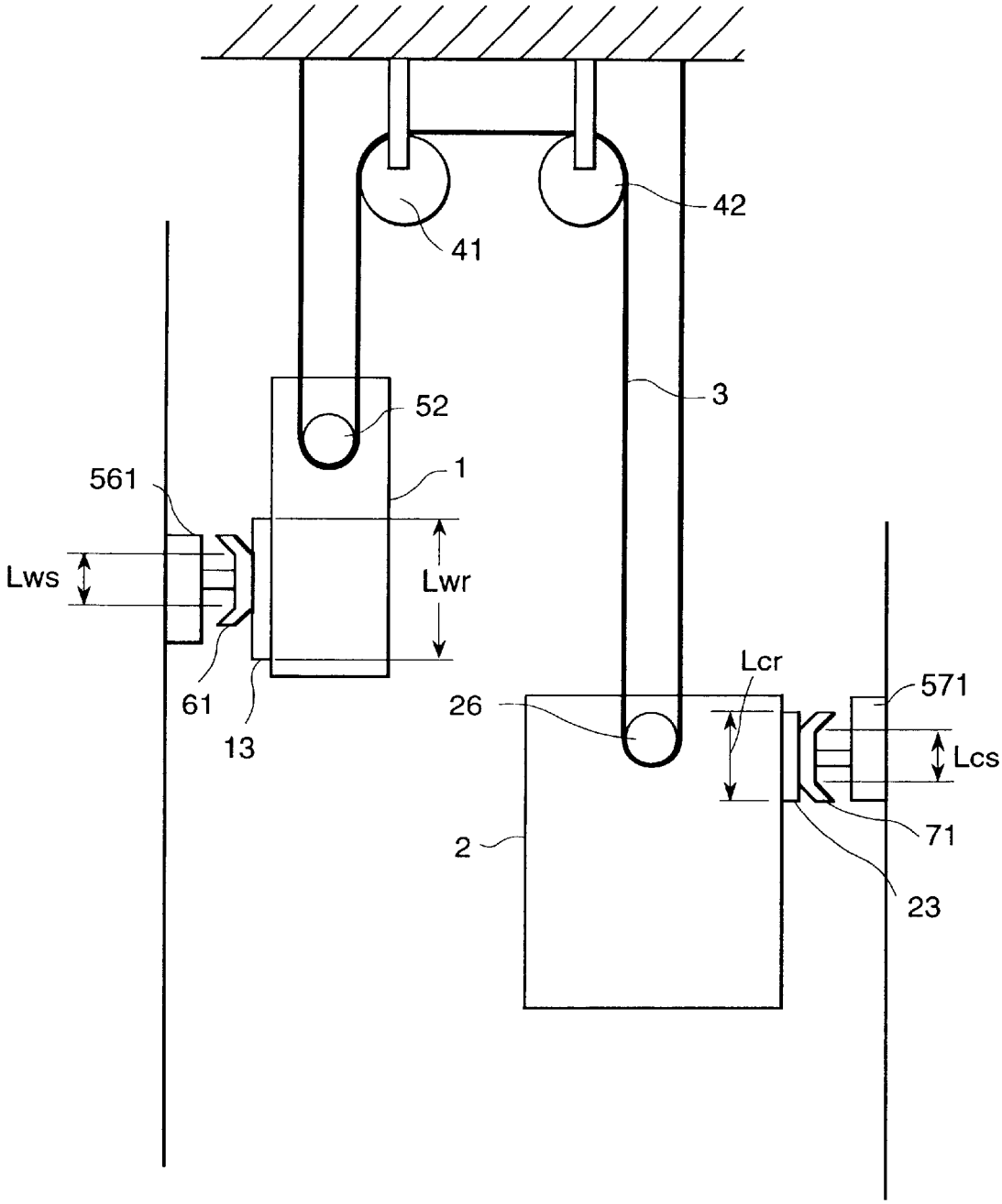
FIG. 14 shows the sixth embodiment of the present invention.

FIG. 14 illustrates the sixth embodiment of the present invention. The structure of this embodiment is similar to the embodiment illustrated by FIG. 13 excluding the power feeding apparatus. This embodiment differs from the embodiment illustrated by FIG. 14 in the point that the physical contact between the power transmission part and the power receiving part enables to supply the electric power to the counter weight and the car. The power transmission part 61 for the counter weight is displaced at the driving apparatus 561 mounted on the wall surface of the hoist way. When the counter weight stops, the power transmission part 61 is made moved closer to the counter weight 1 by the driving apparatus 561, and then, contacts mechanically to the power receiving part 13 disposed at the counter weight 1. As the power transmission part 61 and the power receiving part 13 are made of conductive materials, the electric power transferred from the power generation apparatus, not shown, for the counter weight connected to the power transmission part 51 is supplied to the counter weight 1 through the mechanical contact part. The length of the part of the counter weight contacting to the power receiving part, measure in the direction along which the counter weight moves in the hoist way, is defined to be the dimension Lws of the power transmission part 61 in this direction. It is understood that the contact part is a part of the power transmission part which could contact to the power receiving part 13. In this embodiment, the dimension Lwr of the power receiving part 13 in the direction along which the counter weight 1 moves in the hoist way is larger the dimension Lws. With this configuration, even if the stop position of the counter weight 1 might be shift from a proper position due to the extension of the rope and such, a reliable mechanical contact can be established. Thus, it will be appreciated that a reduction of the power feeding efficiency and the disabled power feeding can be avoided. The driving power required for the driving apparatus 561 can be smaller and a reliable electrical contact can be established with smaller Lws as in this embodiment. Though it is alternatively possible to drive the power receiving part 13, there is no need for installing a driving apparatus into the counter weight 1 and the structure of the counter weight 1 can be made simplified as in this embodiment in which the power transmission part is driven.

In the embodiment illustrated by FIG. 14, the electric power can be supplied similarly to the car 2 by establishing a physical contact between the power transmission part 71 and the power receiving part 23. When the car 2 stops, as in the similar way to the embodiment illustrated by FIG. 13, the power transmission part 71 mounted with the driving apparatus 571 mounted on the wall face of the hoist way is made moved closer to the car 2 by the driving apparatus 571, and then, contacts mechanically to the power receiving part 23 disposed at the car 2. The electric power supplied to the power transmission part 71 from the power generation apparatus, not shown, for the car connected to the power transmission part 71 is fed through a mechanical and electrical contact part of the power transmission part 71 and the power receiving part 23, both made of conductive materials, to the car 2. The length of the part of the car 2 contacting to the power receiving part 23 measure in the direction along which the car moves in the hoist way, is defined to be the dimension Lcs of the power transmission part 71 in this direction. It is understood that the contact part is a part of the power transmission part that could contact to the power receiving part 23. As in the similar ways to FIG. 13, it is preferable also in this embodiment that Lwr/Lws (λw) is made larger than Lcr/Lcs (λc). In addition, as the accuracy in positioning the car to a given floor is higher than that the accuracy in positioning the counter weight is, Lcr is made smaller than Lwr. As Lcr is larger than Lcs even if making Lcr smaller, the reliability for electric power feeding to the car 2 may be high enough. A higher reliability in electric power feeding to the counter weight can be established by making the length of the power receiving part 13 longer than the length of the power transmission part 61. In addition, in case that the material cost for the power receiving part 13 for the counter weight and the power receiving part 23 for the car is determined by the length or volume of the power receiving part, as the size of the power receiving part 23 for the car can be reduced, the cost for the power feeding apparatus can be reduced resultantly.

Figures 15, 16, 17:
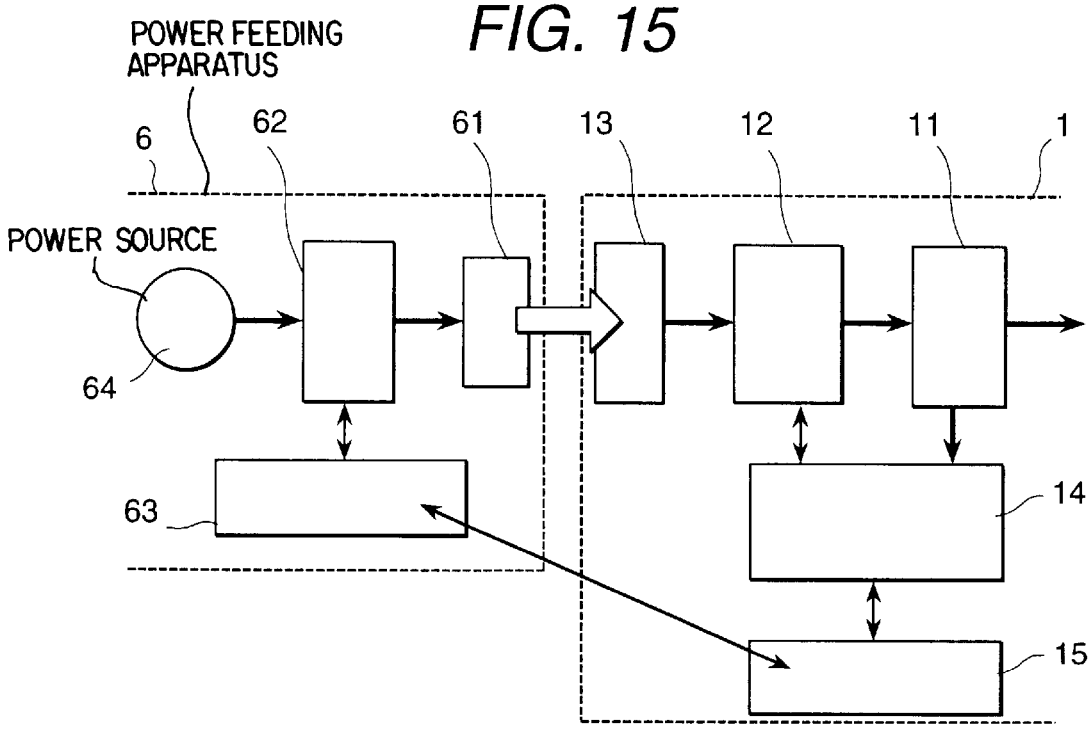
FIG. 15 shows ON-and-OFF control of the power feeding circuit in the power feeding apparatus.
FIG. 16 shows another ON-and-OFF control of the power feeding circuit.
FIG. 17 shows still another ON-and-OFF control of the power feeding circuit.

FIG. 15 illustrates a scheme for On-Off control of the power transmission circuit in the power feeding apparatus that can be applicable to the individual above-mentioned embodiments. FIG. 15 shows the power feeding apparatus 6 having a power transmission part 61, a power transmission circuit 62, a power transmission control part 63 and a power supply 64, and the counter weight 1 having a power receiving part 13, a charging circuit 12, a secondary battery 11, an elevator control part 14 and a communication apparatus 15, and the other minor components are not shown. The state of the elevator is transmitted from the communication apparatus 15 mounted on the counter weight 1 to the power transmission control part 63 as a part of the power feeding apparatus 6. In responsive to the command indicating that the elevator stops at a given position where the electric power can be supplied to the counter weight 1, that is, by judging whether there exists a power-feeding enable position stop command, the power transmission control part 63 turns on or off the operation of the power transmission circuit 62.

By means that the power transmission circuit is controlled in responsive to the state of the elevator, the electric power consumption in the power transmission circuit can be reduced which leads to an effect on energy saving.

FIG. 16 illustrates another scheme for On-Off control of the power transmission circuit. In case of using electromagnetic coupling for the non-contact power feeding method, the inductance between the power receiving part 13 and the power transmission part 61, being viewed from the power transmission circuit 62, changes. The power transmission operation is controlled by this change in inductance. The power transmission operation is turned on if the inductance viewed from the power transmission circuit represents a connecting state, that is, a state showing that the power transmission part 61 and the power receiving part 13 are connected electrically; the power transmission operation is turned off if the inductance shows a non-contacting state, that is, a stat showing that the power transmission part 61 and the power receiving part 13 are not connected electrically, including that the power receiving part 13 is not located at a proper position for getting the electric power. This way of controlling the power transmission operation may contribute to energy saving. In this case, as the information at the elevator control part 14 shown in FIG. 15 is not required to be transferred from the communication apparatus 15 to the power transmission control part 63, the overall apparatus can be simplified.

Turning on and off of the power transmission can be easily realized, for example, by operating and suspending the high-frequency inverter for supplying high-frequency current to the power transmission part 61. Though it is one of alternative methods to turn off the power supply 64 itself in the power feeding apparatus, this embodiment assumes to control the power transmission circuit 62 including the part for controlling the power supply 64.

FIG. 17 illustrates still another scheme for On-Off control of the power transmission circuit. In this case, the power transmission circuit 62 is controlled in responsive to the remaining power of the secondary battery 11. When the secondary battery 11 is fully charged, there is not need for feeding the electric power to the power receiving part 13 even if it is located at the position where the electric power feeding can be enabled. Thus, energy saving operation and adequate usage of the secondary battery can be attained by controlling the power transmission operation based on the remaining power of the secondary battery 11.

The monitoring of the remaining power of the secondary battery 11 can be performed at the battery monitoring part 111 by detecting the voltage and the charging and discharging current. There are several commercial secondary batteries with battery control unit, in which this battery control unit has a functionality for the battery monitoring part 111 as well as an overcharge prevention function. Thus, though there is a lower risk in making the performance of the secondary battery degrade, it contributes more effectively to saving energy saving operation to control directly the power transmission operation because the energy is released within the battery control unit, if any.

As for the means for reporting the information relating to the remaining power of the secondary battery 11, there are several methods such that this information is transferred through the communication apparatus 15 to the power transmission control part 63, and that the charging circuit 12 is controlled based on the remaining power of the secondary battery, and the inductance of the power transmission and receiving parts viewed from the power transmission circuit 62 may be adjusted.

Turning on and off control of the power transmission circuit in the above-mentioned FIGS. 15 to 17 can be applicable to the elevators having a power feeding apparatus supplying the electric power to the counter weight or the car as well as the above-described embodiments.

Figure 18:
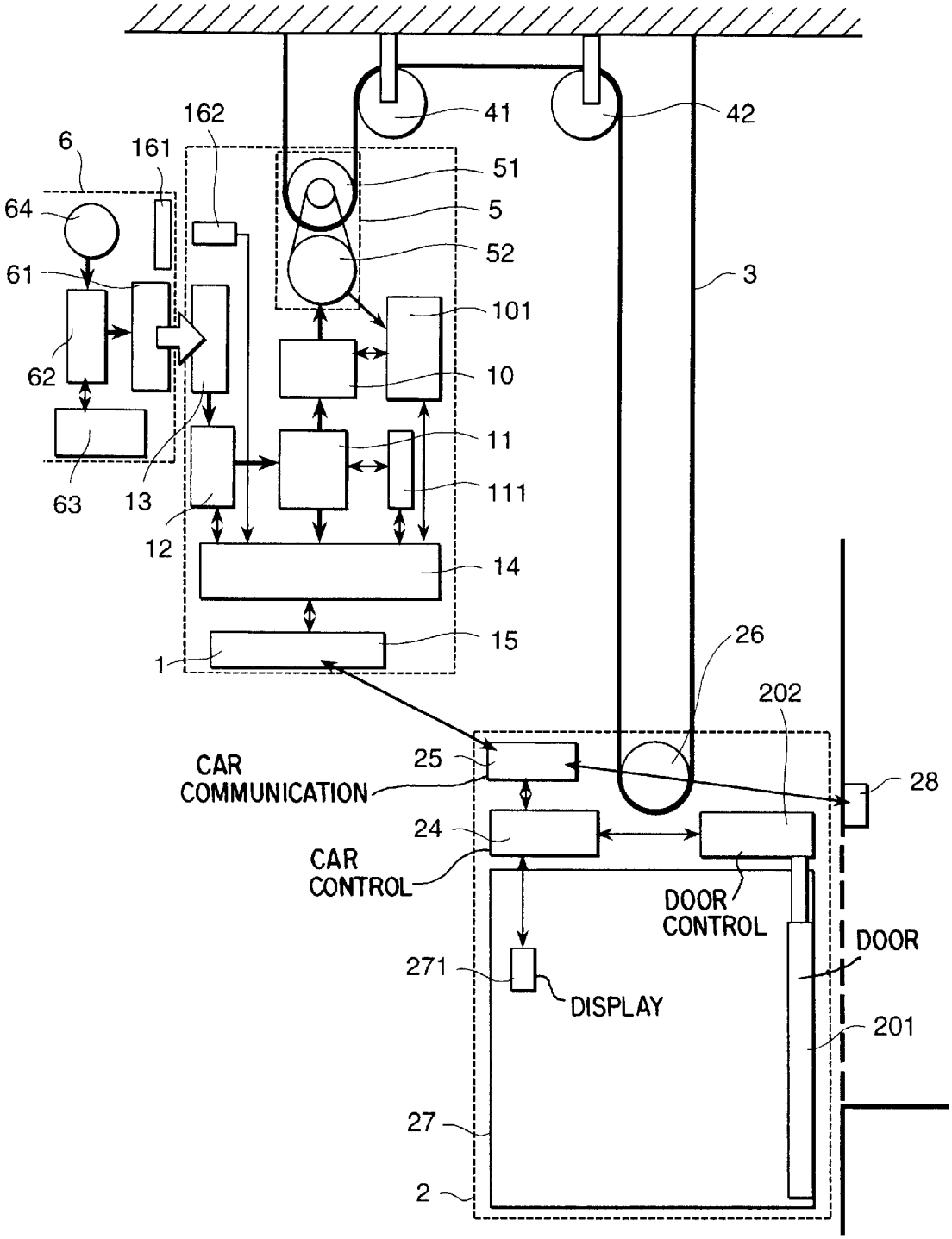
FIG. 18 shows the seventh embodiment of the present invention.

FIG. 18 illustrates the seventh embodiment of the present invention. The structure of the elevator shown in FIG. 18 is almost the same as that shown in FIG. 1, but, in this embodiment, position detectors 161 and 162 for detecting the position of the power receiving part 13 disposed on the counter weight 1 are mounted on the power feeding apparatus 6 and the counter weight 1, respectively. The position information is captured by the elevator control part 14, and the driving apparatus 5 is controlled so that the relative position between the power transmission part 61 and the power receiving part 13 may be optimized. With this optimization, highly efficient power feeding can be attained. Though there are several implementations for the position detector such as well-known optical method and magnetic method, their detail description is not disclosed here.

In the structure shown in FIG. 18, in trying to position the counter weight 1 and the power feeding apparatus 6 for preparing the power feeding operation, the extension of the rope makes the position of the car 2 a little below the optimal position for the passengers getting on and off the car. To solve this problem, the car communication apparatus 25 receives the information for positioning the counter weight 1 from the counter weight communication apparatus 15, and then the car apparatus control part 24 controls the door control apparatus 202 to close the door 201 until the positioning operation completes. As there may be such a case that some passengers in the car are waiting for the arrival at a given floor, it is effective to notify them this positioning operation with an in-cabin display device 271, or it is effective for preventing the passengers, if any, from enclosed in the car to verify the existence of passengers in the car by detecting the in-car request for calling a given floor or judging the output from the load-sensing device to be zero. It is effective for preventing the reduction in the service level of the elevator and for asking the passengers to understand the meaning of saving energy to display "Out of Service" messages on the car entrance display device 28 in order to guide the waiting passengers to use adjacent elevators on the floor. Though the information for the message to be displayed on the car entrance display device 28 is transferred from the car communication apparatus 25 in this embodiment, it is allowed to transfer this information directly from the counter weight communication apparatus 15. There is a call apparatus, not shown, at the car entrance on the floor, and as this apparatus has a function for transferring the call information to the elevator control part 14, there is no problem in transferring the call information to the car entrance display device 28. It is well understand that the message displayed on the car entrance display device 29 on a given floor can be displayed on the car entrance display devices on the other floors.

The position sensors 161 and 162, or for the in-cabin display device 271 and the car entrance display device 28 may be located in arbitrary places which can satisfy their intended functionalities. Though the structure shown in FIG. 18 uses the in-car display device 271, it is allowed to integrate its function into the floor indicator which indicates the current position of the car, which may lead to an effective downsizing of the apparatus. The functionality of the car entrance display device 28 may be similarly integrated into the floor indicator as well. The in-car display device 27 and the car entrance display device 28 can effectively integrate voice navigation for the information communication as well as visual display.

Though the structure shown in FIG. 18 contains components only required to disclose this embodiment, it is well understood that the secondary battery 21 and the devices for electric power feeding can be also disposed at the car 2 as shown in FIG. 1.

Figure 19:
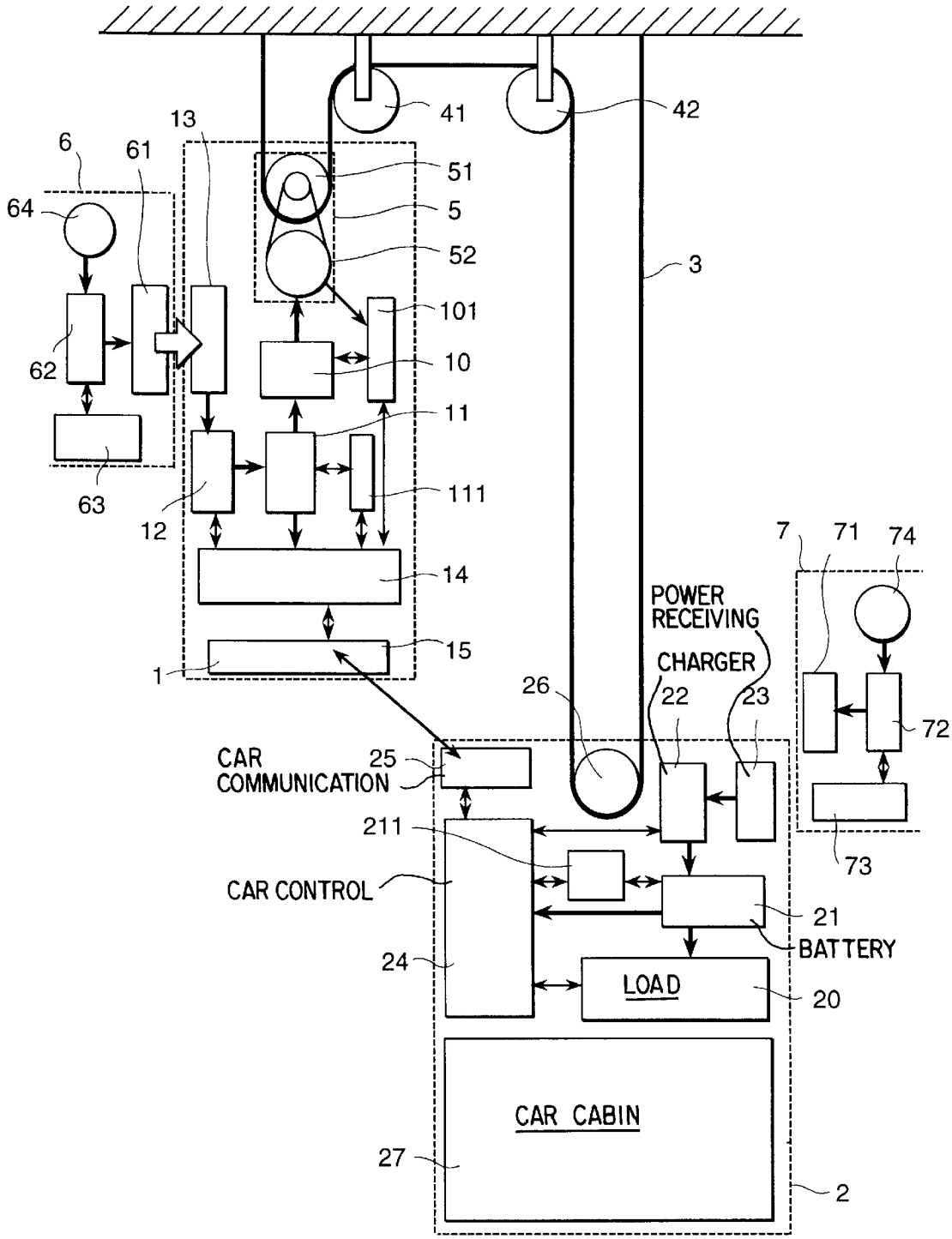
FIG. 19 shows the eighth embodiment of the present invention.

FIG. 19 illustrates the eighth embodiment of the present invention. In the structure shown in FIG. 19, as in the case illustrated by FIG. 18, the driving apparatus 5 is controlled when feeding the electric power to the counter weight 1 so that the power transmission part 61 for the counter weight 1 may face to the power receiving part 13, in which the electric power is not fed to the car 2. Under this operational condition, assume that the remaining power of the secondary battery 21 at the car is extremely low. If the remaining power of the secondary battery 21 goes down below a given level, there may be such a risk that the load 20 in the car does not operate normally. In order to solve this problem, the car 2 ad the counter weight 1 is made move so that the power transmission part 71 ay face exactly to the power receiving part 23 in this embodiment. Along with this operation, the remaining power of the secondary battery 21 at the car is detected by the battery monitoring part 211, and an instruction for requesting to charge the battery is transferred to the elevator control part 14 through the car device control part 24, the communication apparatus 25 and the counter weight communication apparatus 15. In responsive to this instruction, the elevator control part 14 controls the elevator to adjust the position of the car 2. As the charging operation is applied to the one more important in this embodiment, and visa versa, it will be appreciate that there may not be caused advantageously such a case that the service could not be provided due to power shortage.

As the elevator cannot be driven properly if the remaining power of the secondary battery 11 at the counter weight is extremely low, the elevator control part 14 performs a priority-sensitive control in considering also the remaining power of the secondary battery 11 at the counter weight. There are several cases for considering the priority such that the one with lower remaining battery power is simply given a higher priority, and that the second battery at the counter weight 1 is charged conditionally by regenerative energy, and thus such a complex condition should be considered for comparison.

The position detectors, not shown in FIG. 19, may be disposed if required. Though the elevator control part 14 is mounted at the counter weight 1 in this embodiment, it is allowed that some of its separated units may be installed onto the car 2 and may be installed at a given position in the hoist way.

In case that both of the counter weight 1 and the car 2 are not located at the position where the electric power feeding, they can be driven according to the remaining power of the secondary batteries 11 and 21 at the counter weight and the car as far as they does not disable the primary function of the system for transporting the passengers.

Figure 20:
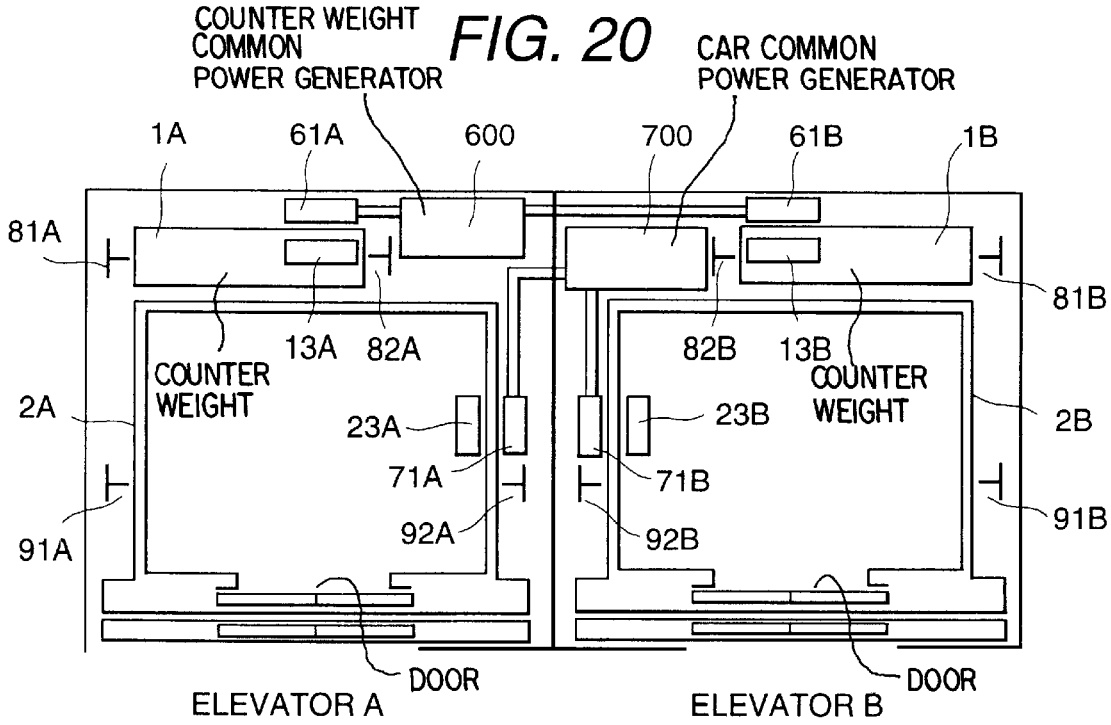
FIG. 20 shows the ninth embodiment of the present invention.

FIG. 20 illustrates the ninth embodiment of the present invention. FIG. 20 illustrates an example in which a couple of elevators A and B are arranged so as to be adjacent to each other, which is shown in a plane view of the hoist way. The counter weight 1A and the car 2A moves in one hoist way, and the counter weight 1*b* and the car 2*b* moves in the other hoist way next to the former hoist way. The electric power feeding to the counter weights 1A and 1B is operated by transmitting the electric power from the common power generation apparatus 600 to the individual power transmission parts 61A and 61B. The electric power feeding to the cars 2A and 2B is operated by transmitting the electric power from the common power generation apparatus 700 to the individual power transmission parts 71A and 71B. The number of component parts and the cross-section of the hoist way can be reduced by sharing the power generation apparatus. The layout of the counter weights, the power transmission parts, the power receiving parts and the power generation apparatus in this embodiment is the same as the layout shown in FIG. 5.

In case that a couple of elevators are arranged so as to be adjacent to each other as shown in FIG. 20, the individual elevators are not operated independently but their operation can be supervised as a group, and thus, they are controlled so as to minimized passengers' waiting time. In this case, by controlling their operation so that the electric power is not fed simultaneously to a couple of elevators, the capacity of the power generation apparatus 600 or 700 can be designed to support substantially a single elevator.

Figure 21:
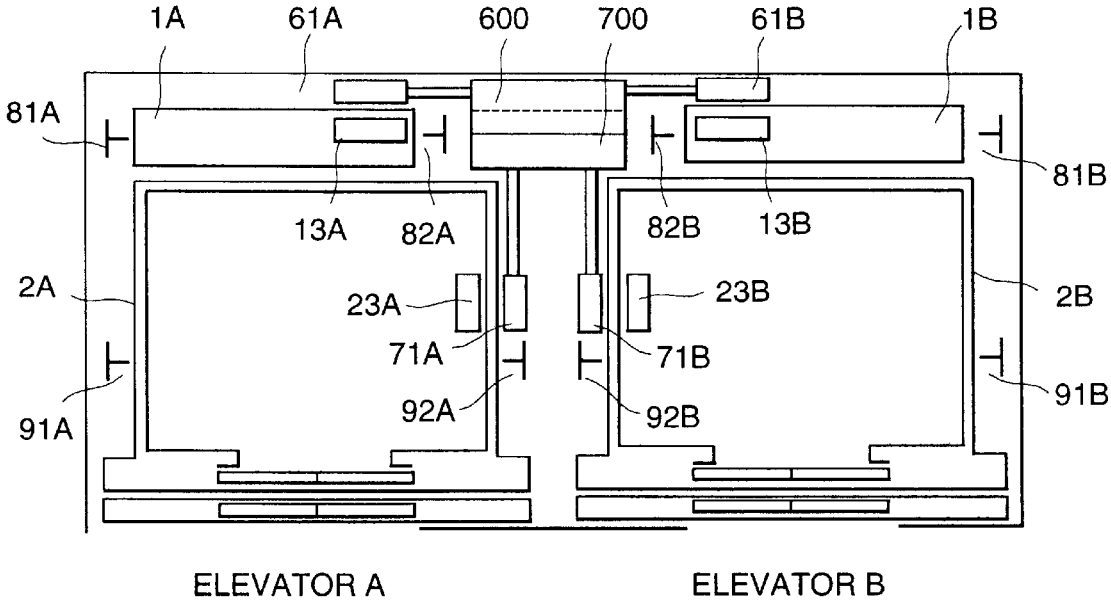
FIG. 21 shows a modification example of the embodiment illustrated by FIG. 20.

FIG. 21 illustrates a modification example of the embodiment shown by FIG. 20. As in FIG. 20, a couple of elevators A and B are arranged so as to be adjacent to each other in FIG. 21. The common power generation apparatus 600 for the counter weight and the common power generation apparatus 700 for the car are disposed in an area covering the adjacent hoist ways. In addition, The common power generation apparatus 600 for the counter weight and the common power generation apparatus 700 for the car are arranged so as to overlap each other partially in a vertically projected plane. With this configuration, the power feeding apparatus can be arranged without expanding the cross-sectional area of the hoist ways. It will be appreciated that the area occupied by the counter weights to be projected on a cross-section of the hoist ways can be expanded, that is, the net weight of the counter weight can be increased without increasing the cross-sectional area of the hoist ways.

In this embodiment, though what is illustrated is such an example that the common power generation apparatus 600 for the counter weight and the common power generation apparatus 700 for the car are arranged so as to overlap each other partially, it is allowed that the individual power transmission parts 61A and 61B, and 71A and 71B may be arranged so as to overlap each other partially, for example, as shown in FIG. 6.

Alternatively, in FIGS. 20 and 21, it is allowed that the common power generation apparatus 600 may supply the electric power to the individual power transmission parts 61A and 71B, and that the common power generation apparatus 700 may supply the electric power to the individual power transmission parts 61B and 71A. In addition, it is allowed that the common power generation apparatus 600 may supply the electric power to the individual power transmission parts 61B and 71A, and that the common power generation apparatus 700 may supply the electric power to the individual power transmission parts 61A and 71B.

Figure 22:
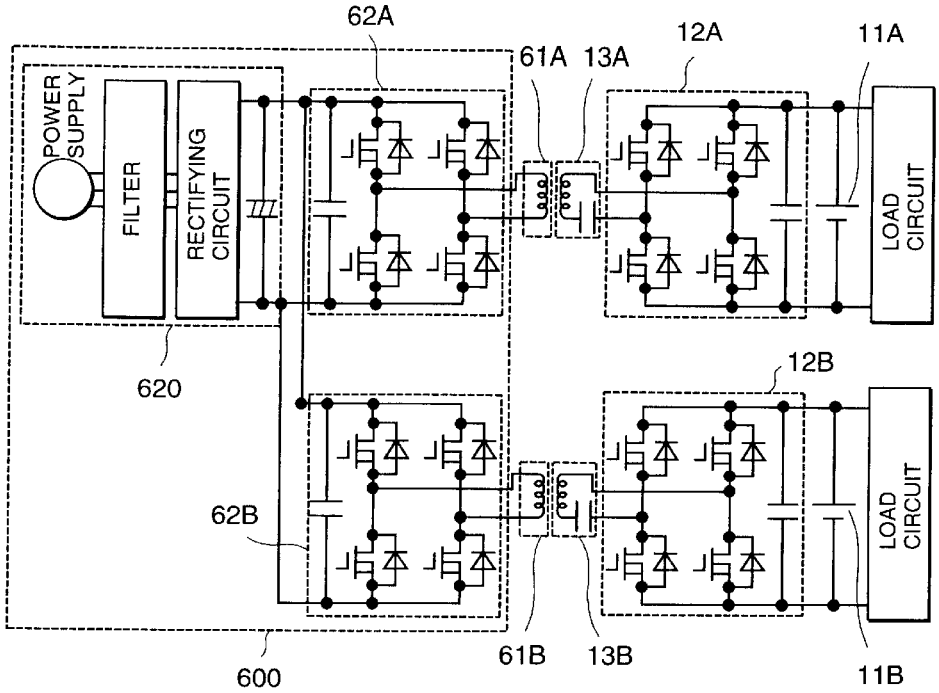
FIG. 22 shows the tenth embodiment of the present invention.

FIG. 22 illustrates the tenth embodiment of the present invention. In this embodiment, as in the embodiments shown in FIGS. 20 and 21, an outline circuit structure of the power transmission and receiving parts is shown in case that the electric power is fed from the common power generation apparatus 600 to the counter weights 1A and 1B of a couple of adjacent elevators by using the high-frequency transformer. The individual secondary batteries 11A and 11B are charged though a couple of high-frequency inverters 62A and 62B connected to the common power supply part 620 in the common power generation apparatus 600, the power transmission parts 61A and 61B as the primary side of the high-frequency transformer, the power receiving parts 13A and 13B as the secondary side of the high-frequency transformer and mounted at the individual counter weights, and the charging circuits 12A and 12B having almost an identical structure to that of the above-described high-frequency inverter. As this embodiment forms a resonant inverter by connecting condensers in series to the transformer winding of the power receiving parts 13A and 13B, the switching device loss of the high-frequency inverter can be reduced. Though the charging circuits 12A and 12B may be formed alternatively as rectification circuit, the circuit structure as shown in the figure makes it possible to feed backward the electric power from the secondary battery 11A or 11B to the high-frequency inverters 62A or 62B as the power transmission circuits. In case that the electric power feeding from the power supply to the common power generation apparatus 600 is discontinued due to power blackouts, for example, and that the secondary battery 11A of the counter weight 1A is fully charged and the secondary battery 11B of the counter weight 1B is almost empty, it will be appreciated that the above-described structure makes is possible to supply the electric power from the secondary battery 11A fully charged by the common power generation apparatus 600 to the almost empty secondary battery 11B.

Not explicitly illustrated here but as in the structure shown in FIG. 22, the power feeding operation can be provided directly to the adjacent cars, if their power receiving parts are arranged so as to come very close. In addition, in case that the power receiving part of the car and the power receiving part of the counter weight are so arranged as to come very close, the power feeding operation to them can be established alternately by operating the car and the counter weight so that their elevation may be identical to each other. With this structure, it will be appreciated that the reliability of the elevator using non-contact mode power feeding and secondary batteries can be increased.

The present invention can be practiced in a variety of embodiments other than those described.

What is claimed is:

1. An elevator having a car and a counter weight, each suspended by a rope, comprising a power transmission part located in a hoist way in which said car and said counter weight moves; and a power receiving part installed in said counter weight and receiving an electric power from said power transmission part, wherein a dimension of said power transmission part and a dimension of said power receiving part, each measured in a direction along which said counter weight moves, are different from each other and wherein said dimension of said power receiving part is larger than said dimension of said power transmission part.

2. An elevator of claim 1, wherein said power transmission part transmits an electric power in non-contact mode to said power receiving part.

3. An elevator of claim 1, further comprising another power transmission part installed in said hoist way, and another power receiving part installed in said car and for receiving an electric power in non-contact mode from said another power transmission part, wherein another dimension of said another power transmission part and said dimension of said another power receiving part, each measured in a direction along which said counter weight moves, are different from each other, and said another dimension of said another power receiving part is larger than said another dimension of said another power transmission part; and a ratio of Lwr to Lws (Lwr/Lws) is larger than a ratio of Lcr to Lcs Lcr/Lcs), in which Lwr is said dimension of said power receiving part, Lws is said dimension of said power transmission part, Lcr is said another dimension of said another power receiving part, and Lcs is said another dimension of said another power transmission part.

4. An elevator of claim 1, wherein said power transmission part transmits an electric power in non-contact mode to said power receiving part.

5. An elevator of claim 3, wherein said power transmission part transmits an electric power in non-contact mode to said power receiving part, and said another power transmission part transmits an electric power in non-contact mode to said another power receiving part.

6. An elevator of claim 4, wherein at least one of said power transmission part and said power receiving part is separated into plural units in said direction.

7. An elevator of claim 4, wherein said power transmission part and said power receiving part are linked by electro-magnetic coupling.

8. An elevator of claim 5, wherein said power transmission part transmits an electric power in non-contact mode to said power receiving part.

9. An elevator of claim 5, wherein said power transmission part and said power receiving part are linked by electro-magnetic coupling.

10. An elevator having a car and a counter weight, comprising a first power generation apparatus and a second power generation apparatus located in a hoist way in which said car and said counter weight moves and for generating an electric power to said car or said counter weight, wherein a projection of said first power generation apparatus and a projection of said second power generation apparatus, each projected in the direction along which said car or said counter weight moves, have an overlapped area.

11. An elevator of claim 10, wherein said first power generation apparatus supplies an electric power to said car; and said second power generation apparatus supplies an electric power to said counter weight.

12. An elevator having a car and a counter weight, comprising a first power transmission part and a second power transmission part located in a hoist way in which said car and said counter weight moves and for generating an electric power to said car or said counter weight, wherein a projection of said first power transmission part and a projection of said second power transmission part, each projected in the direction along which said car or said counter weight moves, have an overlapped area.

13. An elevator of claim 12, wherein said first power transmission part and said second power transmission part transmit an electric power in non-contact mode to said car or said counter weight.

14. An elevator having a first car and a first counter weight, each moving in a first hoist way, and a second car and a second counter weight, each moving in a second hoist way; comprising a first power transmission part for transmitting an electric power to said first car or said first counter weight;

a second power transmission part for transmitting an electric power to said second car or said second counter weight; and a power generation apparatus connected commonly to said first and second power transmission parts and for generating an electric power to be transmitted from said first and second transmission parts.

15. An elevator of claim 14, wherein said first power transmission part transmits an electric power in non-contact mode to said first car or said first counter weight; and said second power transmission part transmits an electric power in non-contact mode to said second car or said second counter weight.

* * * * *